US005377649A

United States Patent [19]

Matsubara et al.

[11] Patent Number: 5,377,649

[45] Date of Patent: Jan. 3, 1995

[54] LUBRICATING DEVICE FOR ENGINE-DRIVEN SUPERCHARGER

[75] Inventors: Hidetsugu Matsubara, Tokyo; Yasuo Tanaka, Chiba; Yoshiyuki Miyagi, Tokyo; Tsuyoshi Goto, Hiroshima; Koichi Hatamura, Hiroshima; Seishiro Takayama, Hiroshima, all of Japan

[73] Assignees: Ishikawajima-Harima Jukogyo Kabushiki Kaisha, Tokyo; Mazda Motor Corporation, Hiroshima, both of Japan

[21] Appl. No.: 70,459

[22] PCT Filed: Oct. 13, 1992

[86] PCT No.: PCT/JP92/01331

§ 371 Date: Jun. 14, 1993

§ 102(e) Date: Jun. 14, 1993

[87] PCT Pub. No.: WO93/08386

PCT Pub. Date: Apr. 29, 1993

[30] Foreign Application Priority Data

Oct. 14, 1991 [JP] Japan ..... 3-291896

[51] Int. Cl.[6] ..... F02B 39/14; F04C 29/02

[52] U.S. Cl. ..... 123/559.1; 413/201.1

[58] Field of Search ..... 123/559.1; 418/201.1

[56] References Cited

FOREIGN PATENT DOCUMENTS

| | | | |
|---|---|---|---|
| 57-102595 | 6/1982 | Japan | 418/201.1 |
| 3-92542 | 4/1991 | Japan . | |
| 3-151521 | 6/1991 | Japan | 123/559.1 |
| 4-42284 | 4/1992 | Japan . | |

OTHER PUBLICATIONS

Japanese Utility Model 1st Publication No. 3-8690 (Laid Open on Jan. 28, 1991) Abridged Translation.

*Primary Examiner*—Michael Koczo

*Attorney, Agent, or Firm*—Oblon, Spivak, McClelland, Maier & Neustadt

[57] ABSTRACT

Oil feed and discharge lines (34) and (35) are respectively connected between an engine (15) and an external oil feed type engine-driven supercharger (I) so as to circulate a lubricating oil (0) between them. The lubricating oil (0) used in the engine (15) is fed through the oil feed line (34) to the supercharger (I) while the lubricating oil (0) used in the supercharger (I) is returned through the oil discharge line (34) to the engine (15). As a result, the lubricating oil and associated parts exclusively for the supercharger can be eliminated.

3 Claims, 4 Drawing Sheets

LUBRICATING DEVICE FOR ENGINE-DRIVEN SUPERCHARGER

TECHNICAL FIELD

The present invention relates to a lubricating device for an engine-driven supercharger for enhancing output performance of an engine.

BACKGROUND ART

As exemplarily shown in FIG. 1, an engine-driven supercharger for supercharging an engine comprises a rotor casing 1 having therein male and female rotors 2 and 3 arranged in juxtaposed and meshed relationship. The rotors 2 and 3 have shafts 6 and 7 rotatably supported by bearings 4*a* and 5*a* at a front and bearings 4*b* and 5*b* at a rear, respectively. One end of each of the shafts 6 and 7 of the rotors 2 and 3 extends through the rotor casing 1 into a gear casing 8 at the front of the rotor casing 1. Timing gears 9 and 10 are mounted on the extensions of the shafts 6 and 7, respectively, in mesh with each other. The gear casing 8 has speed increasing gears 11 and 12 therein in meshed relationship. The smaller-diameter gear 11 is mounted on the shaft 6 of the male rotor 2 while the larger-diameter gear 12 is mounted on one end of an input shaft 14 which is supported by bearings 13*a* and 13*b* and extends at its other end away from the rotor through the gear casing 8. A pulley 16 is rotatably mounted through a bearing 17 on an outer periphery of the end of the input shaft 14 extending through the gear casing 8. The pulley 16 is connected through a belt 18 to a pulley 22 mounted on an output shaft of an engine 15 such that output from the engine 15 is transmitted through the pulley 22 and the belt 18 to the pulley 16. Furthermore, an electromagnetic clutch 19 is arranged between the pulley 16 and the input shaft 14 such that rotation of the pulley 16 is transmitted to the rotors 2 and 3. When the electromagnetic clutch 19 is on and the rotating power of the engine 15 is transmitted through the pulley 22 and the belt 18 to the pulley 16, the rotation of the pulley 16 is transmitted through the electromagnetic clutch 19 to the input shaft 14, is accelerated through the speed increasing gears 12 and 11 and then is transmitted to the timing gears 9 and 10. The male and female rotors 2 and 3 are timed in rotation in the rotor casing 1 by the liming gears 9 and 10 so that air sucked through a suction port 20 at the rear of the rotor casing 1 is compressed, is delivered through a delivery port 21 at the front of the rotor casing 1 and is supercharged to the engine 15. Reference numerals 23*a* and 23*b* denote sealing means.

In the the engine-driven supercharger described above, because of the rotors 2 and 3 being rotated at high speed, the bearings 13*a* and 13*b* for supporting the input shaft 14, the bearings 4*a*, 5*a*, 4*b* and 5*b* at the front and rear for supporting the shafts 6 and 7 of the rotors 2 and 3 and the like must be prevented from being worn out. For this purpose, so far an internal enclosing system has been employed in which a lubricating oil is enclosed in the front and rear of the rotor casing 1 so that oil films are formed by the enclosed lubricating oil over sliding surfaces of the respective bearings.

High speed rotation of the rotors, however, causes an amount of heat generated to be increased, which raises in temperature the delivered air and consequently the casings 1 and 8 so that the lubricating oil is increased in temperature by such generation of heat. As a result, in the above-mentioned internal enclosed lubrication, there are fears that no oil film may be formed over the sliding surfaces and that once raised in temperature, the lubricating oil is hard to forcedly cool. These will accelerate contact of the metal sliding surfaces of the bearings with each other, resulting in the sliding surfaces being readily worn out.

To overcome these problems, a so-called external oil feed system has been proposed in which the lubricating oil is fed from an exterior to the rotor casing 1 and gear casing 8, is passed through parts to be lubricated at the front and rear of the rotors and is discharged out of the rotor casing 1 (Japanese utility model 2nd publication No. 3-8690).

The supposed external oil feed type engine-driven supercharger is structurally similar to the supercharger shown in FIG. 1 in that the air sucked through the suction port 20 at the rear of the rotor casing 1 is compressed, is delivered through the delivery port 21 at the front of the rotor casing 1 and is supercharged to the engine 15 and comprises, as schematically shown in FIG. 2, an oil feed port 24 at the front of the rotor casing 1 for introducing part of an engine oil to feed the same as lubricating oil and first and second oil discharge ports 25*a* and 25*b* respectively at the front and rear of the rotor casing 1, the lubricating oil 0 from the feed port 24 being passed through a lubricating oil passage 26 between the rotors 2 and 3 in the rotor casing 1 to the bearings 4*a*, 5*a*, 4*b* and 5*b* to be lubricated at the front and rear and being discharged through the first and second discharge ports 25*a* and 25*b*.

DISCLOSURE OF THE INVENTION

So far, in this manner, lubricating oil is fed to an engine-driven supercharger by a lubricating system exclusively for supercharging, which will increase kinds of oil required and necessitate associated devices such as lubricating oil pump and oil cooler. This may cause a problem of interference in arranging such associated devices and other vehicle parts and is disadvantageous in maintenance cost.

In the engine-driven supercharger of the type described above, the feed port 24 is provided at the front and the discharge ports 25*a* and 25*b* are provided at the front and rear so as to discharge the oil by gravity. It is because the feed of the lubricating oil to the front must be preferentially carried out for the reason that many parts such as bearings and gears to be lubricated are arranged at the front and because the lubricating oil from the engine normally compressed on the order of 3 $kg/cm^2$ may flow to the suction side but cannot be returned to the feed port 24 again. The air delivered through the delivery port 21 is being compressed and being heated and the engine oil fed as lubricating oil 0 from the engine to the feed port 24 has temperature as high as 100° C. so that the lubricating oil 0 discharged after the lubrication through the first discharge port 25*a* has temperature as high as 150° C., which causes a problem in that satisfactory lubricating effects cannot be obtained due to high-temperature deterioration.

There is a further problem that especially the sealing means 23*a* and 23*b*, which are mechanical seals for the rotors 2 and 3 rotating at high speed, tend to be violently worn due to frictional heat generated by the high-speed rotation. More specifically, as exemplarily shown in FIG. 3, the mechanical seals used as the sealing means 23*a* and 23*b* comprises a carbon ring 30 axially movably arranged in a holding case 29. The carbon ring 30 has a leading edge surface in contact with one side surface of a mating ring 28 which in turn is attached to an outer periphery of the shaft 6 or 7 of the rotor 2 or 3. The leading edge surface of the carbon ring 30 is pressed against the mating ring 28 under the force of a spring 31 loaded between a rear edge of the carbon ring 30 and the holding case 29 so that a slide-sealing surface is defined by the surface of contact between the rings 28 and 30. In addition, a seal ring 32 is fitted between an inner periphery of the carbon ring 30 and an inner wall surface of the holding case 29 so that the lubricating oil flowing into the holding case 29 through a port 33 drilled through an outer wall of the holding case 29 is prevented from leaking by the slide-sealing surface defined by the rings 28 and 30 and the seal ring 32. Due to such sealing structure, the mating ring 28 which is normally heated by friction to between 160° and 170° C. is further increased in temperature to the order of 200° C. when the lubricating oil having the temperature of 100° C. flows in. As a result, the mating ring 28 is tempered and is heavily worn out.

In view of the above, the present invention is directed to lubrication of an engine-driven supercharger, using a lubricating oil for an engine in common, and provides a lubricating device for an engine-driven supercharger which can eliminate any lubricating oil exclusively for supercharging and its associated devices and which prevents any deterioration of the lubricating oil due to high temperatures and ensures satisfactory lubrication effects, thereby enhancing the durability of the bearings and sealing means and the reliability of the supercharger.

To this end, according to the present invention, respectively connected between an engine and an external oil feed type engine-driven supercharger for compressing sucked air and supercharging the same into the engine are an oil feed line for feeding to the supercharger the lubricating oil having been used in the engine and an oil return line for returning the lubricating oil having been used in the supercharger to the engine, whereby the lubricating oil is used in common in the engine and the supercharger.

The engine-driven supercharger used may be of the type in which shafts of male and female rotors disposed in parallel with each other in a rotor casing are rotatably supported at a front and a rear of the rotor casing, an air suction port being provided at the rear while a compressed air discharge port is provided at the front, lubricating oil fed from an exterior being forced to pass parts to be lubricated at the front and rear and then discharged to the exterior. In this case, an oil feed port is formed at the rear of the rotor casing.

The delivery port may be opened radially of the rotor casing and a lubricating oil passage downstream of the oil feed port may be provided in a wail of the rotor casing at a position diametrically opposite to said delivery port.

A distribution line may be branched from the lubricating oil passage so as to feed the lubricating oil to a gear casing at the front of the rotor casing.

According to the l,resent invention, the lubricating oil having been used in the engine is fed through the oil feed line to the supercharger to thereby lubricate the same; and the lubricating oil having been used in the supercharger is returned through the oil discharge line to the engine. It follows therefore that the lubricating oil can be used for lubrication of both the engine-driven supercharger and the engine and that lubricating oil exclusively for the engine-driven supercharge and its associated parts or devices can be eliminated.

Provision of the oil feed port at the rear of the rotor casing having the suction port means that the high-temperature lubricating oil from the engine is directed to a portion which is located at the side of the suction port and which is relatively low in temperature so that the lubricating oil is cooled and then is distributed to various parts to be lubricated.

Provision of the lubricating oil passage downstream of the oil feed port and in the wall of the rotor casing away from the delivery port means that the lubricating oil is cooled at a portion of the rotor casing which is cool.

Moreover, provision of the distribution line branched from the lubricating oil passage to feed the lubricating oil to the gear casing means that the lubricating oil cooled by the rotor casing is fed to parts such as speed increasing gears at which the temperature is maximum.

BEST MODE FOR CARRYING OUT THE INVENTION

Figure 1:
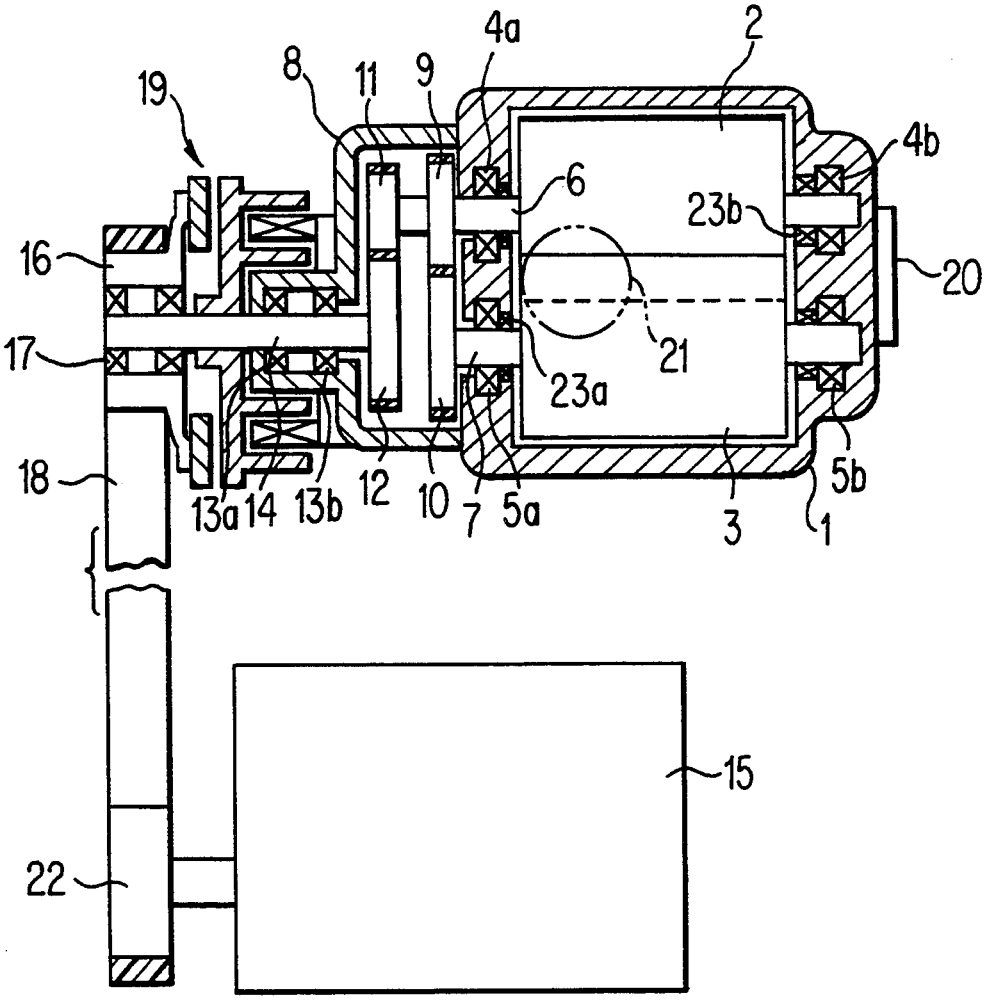
FIG. 1 is a schematic view of an example of engine-driven supercharger.
Figure 2:
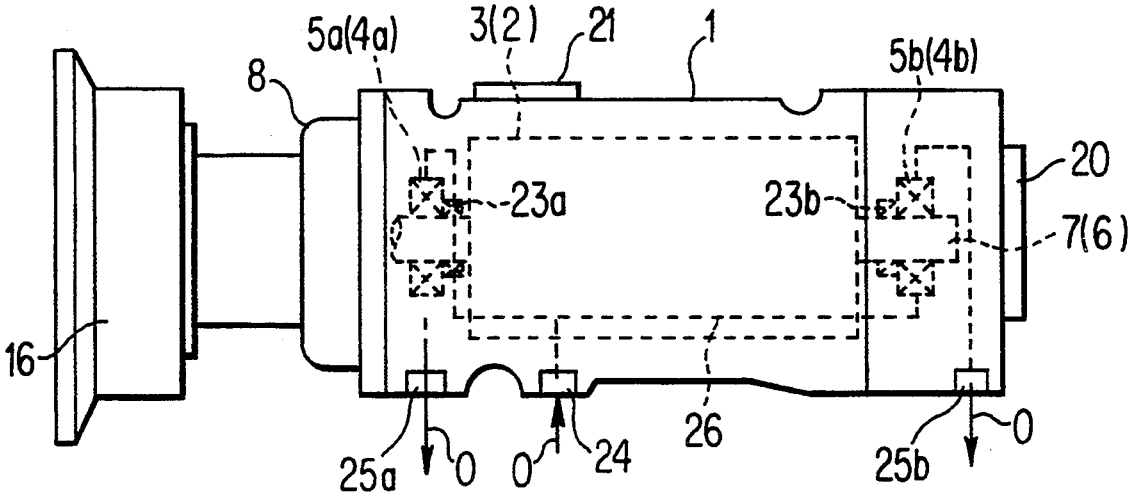
FIG. 2 is a schematic view of an example of external oil feed type engine-driven supercharger having been proposed.
Figure 4:
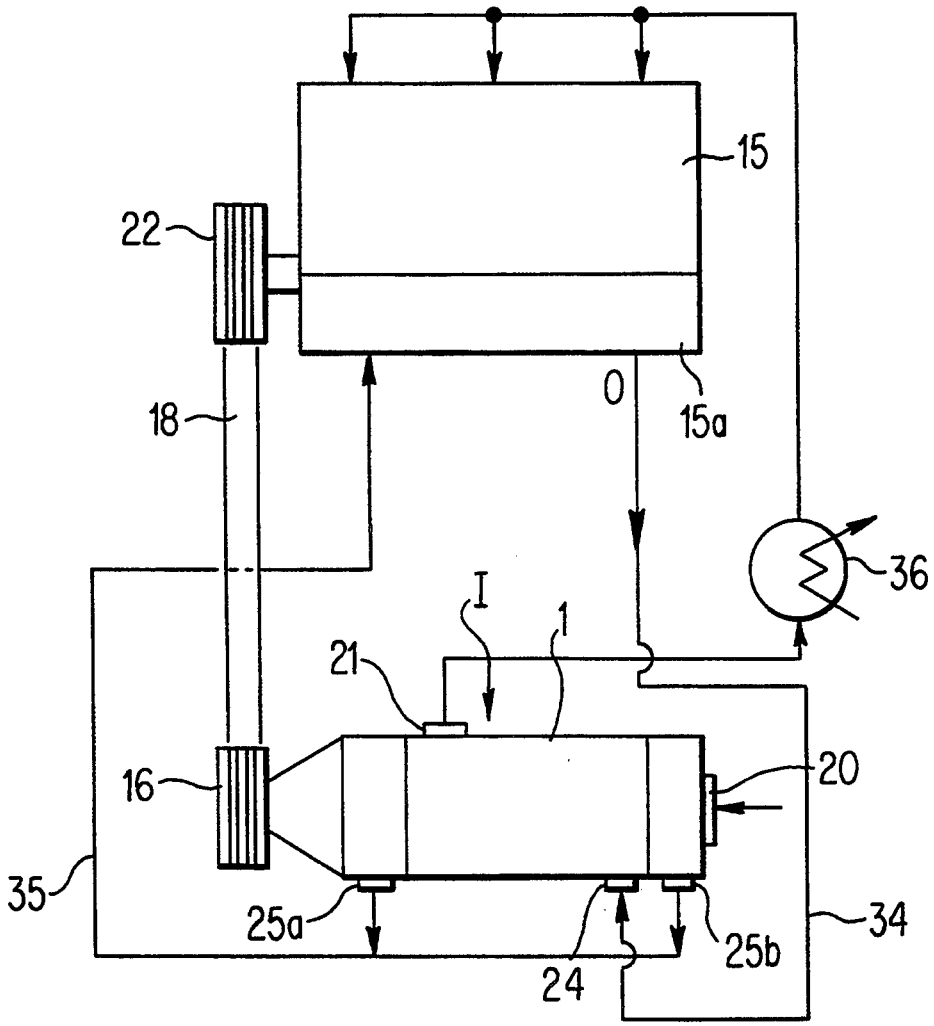
FIG. 4 is a schematic view of an embodiment of a lubricating device for an engine-driven supercharger in accordance with the present invention.
Figure 5:
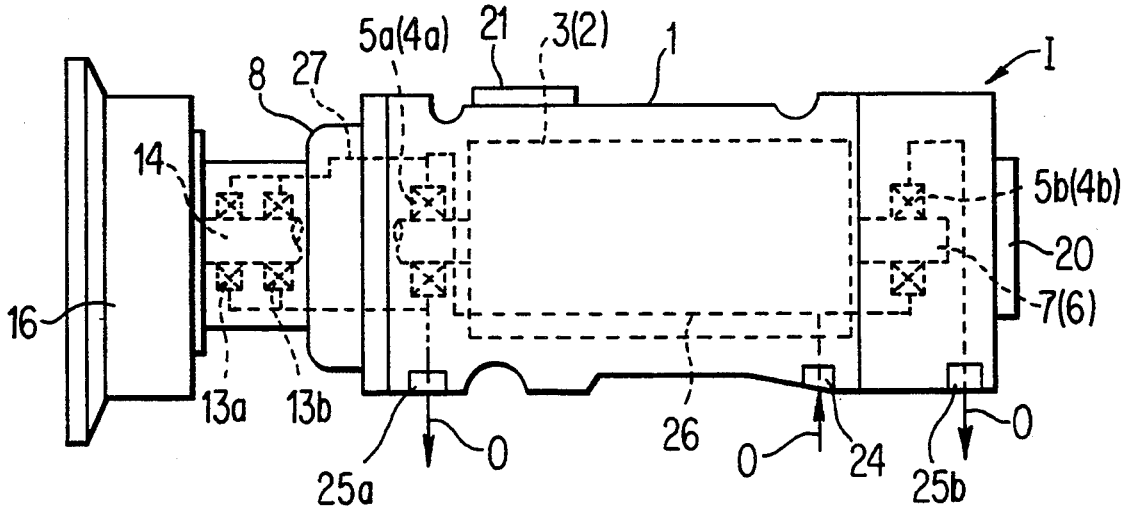
FIG. 5 is a schematic view of an example of the oil feed system of the engine-driven supercharger shown in FIG. 4.
Figure 6:
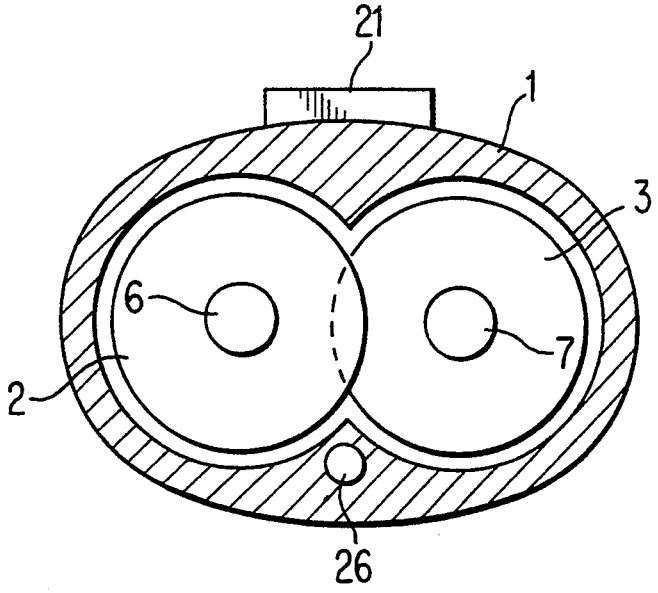
FIG. 6 is a cross sectional view thereof.

FIGS. 4 to 6 illustrate an embodiment of the present invention. An external oil feed type engine-driven supercharger I is similar to the supercharger shown in FIG. 2 in that the air sucked through the suction port 20 at the rear of the rotor casing 1 is compressed, is delivered through the delivery port 21 at the front of the rotor casing 1 and is supercharged into the engine 15, and comprises an oil feed port 24 and a second oil discharge port **25*b* at the rear of the rotor casing 1 and a first oil discharge port 25*a* at the front of the rotor casing; the lubricating oil 0 fed through the oil feed port 24 is directed, through the lubricating oil passage 26 defined in the wall diametrically opposite to the delivery port 21 and between the rotors 2 and 3 of the rotor casing 1, to the bearings 4*a* and 5*a* to be lubricated at the front as well as the bearings 4*b* and 5*b* to be lubricated at the rear and is discharged through the first and second discharge ports 25*a* and 25*b* while it is directed, through a distribution line 27 branched at the front, to the bearings 13*a* and 13*b* for the input shaft 14 and the speed increasing gears to be lubricated in the gear casing 8 and is discharged through the first discharge port 25*a*. The lubricating oil 0 is used in common in the engine-driven supercharger I and the engine 15. More particularly, an oil feed line 34 is connected between the oil feed port 24 of the rotor casing 1 and an oil pan 15*a* of the engine 15 so that the lubricating oil having been used in the engine 15 is fed to the rotor casing 1. An oil discharge line 35 is connected between the first and second discharge ports 25*a* and 25*b* of the rotor casing 1 on the one hand and the oil part 15*a* of the engine 15** on the other hand so that the lubricating oil having been used in the parts to be lubricated in the rotor casing 1 can be returned to the engine 15. Thus, the lubrication system is constructed to use the lubricating oil in common in the engine-driven supercharger I and the engine 15. In FIG. 4, reference numeral 36 represents an intercooler for cooling the delivered or exhaust air.

Because of the above-described construction, the lubricating oil 0 having been used in the engine 15 is fed from the oil pan 15a through the oil feed line 34 to the rotor casing 1 of the engine-driven supercharger I to thereby lubricate the parts to be lubricated in the rotor casing 1. The lubricating oil 0 which has been used to lubricate the parts to be lubricated in the casing 1 is returned through the oil discharge line 35 to the oil pan 15*a* of the engine 15 where it is used for lubrication of the engine 15. In this manner, the lubricating system is arranged in which the lubricating oil 0 having been used in the engine 15 is fed to the engine-driven supercharger I and then returned back to the engine 15, so that the lubricating oil 0 which is used in the engine-driven supercharger I can be used in common in the engine 15. As a result, kinds of oils which must be used in the engine system can be decreased in number and the lubricating oil pump and the oil cooler for the engine can be also used in common for the engine-driven supercharger I. As a consequence, associated devices such as a lubricating oil pump and an oil cooler exclusively for the engine-driven supercharger can be eliminated so that relative arrangements of various parts on a vehicle present no problem and extreme advantage in maintenance cost is ensured.

Figure 3:
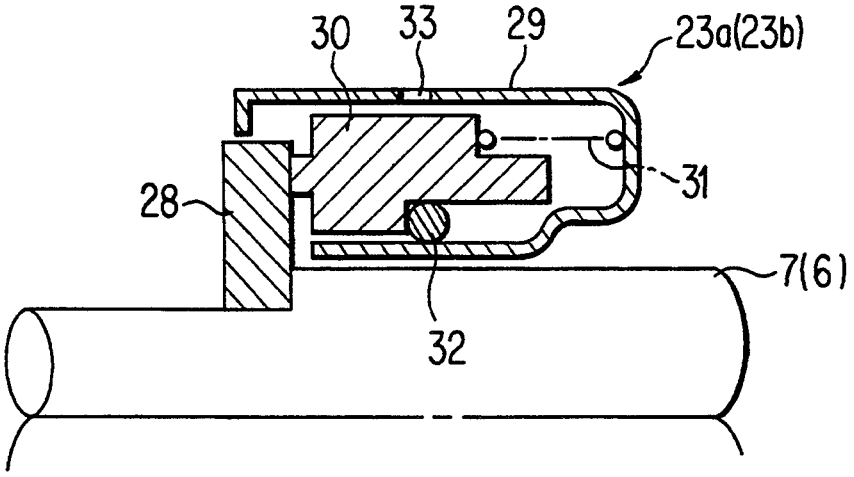
FIG. 3 is a sectional view of a mechanical seal.

In the above-described construction, the lubricating oil 0 from the oil feed port 24 flows past the bearings 4*a* and 5*a* and the sealing means 23*a* to be lubricated at the front as well as the timing gear 9 and 10, the speed increasing gears 12 and 11 and the bearings 13*a* and 13*b* to be lubricated in the gear casing 8 and is discharged through the first discharge port 25*a*. In this case, since the oil feed port 24 is located at a position adjacent to the suction port 20 of the rotor casing 1 and the lubricating oil passage 26 downstream of the oil feed port 24 is defined in the wall of the rotor casing 1 and away from the delivery port 21, the lubricating oil 0 from the oil feed port 24 is cooled. More particularly, the air which is sucked through the suction port 20 and is not yet highly compressed is lower in temperature than that of the air compressed and delivered through the delivery port 21. As a result, the lubricating oil 0 which is fed from the oil feed port 24 flows through the oil passage which is cooled by the low temperature air to the parts to be lubricated at the front and in the gear casing 8 so that even when the lubricating oil 0 from the engine 15 is high in temperature, the lubricating oil is fed to the parts to be lubricated while being cooled as compared with the system shown in FIG. 2 in which the lubricating oil is fed through the oil feed port 24 adjacent to the delivery port 21. As a result, good lubrication effects can be obtained without causing deterioration due to high temperatures. Especially, the mating seal 28 (See FIG. 3) in the sealing means 23*a* at the front having frictional heat due to its high rotation is made contact with and cooled by the lower-temperature lubricating oil 0 so that the problem of the mating seal being tempered and violently worn out can be avoided in advance. As in the cases of the parts to be lubricated at the front and in the gear casing 8, the parts to be lubricated at the rear can be satisfactorily lubricated by the cooled lubricating oil in a stable manner. Thus durability of various parts to be lubricated such as bearings and sealing means can be enhanced and highly reliability of the supercharger can be ensured.

So far in the above-mentioned embodiment, the engine-driven supercharger has been described as having one oil feed port and two oil discharge ports; but it is to be understood that the present invention is not limited to these numbers and that various modifications may be effected without leaving the true spirit of the present invention.

As described above, according to the lubricating device for the engine-driven supercharger of the present invention, connected between the supercharger and the engine are an oil feed line for feeding the lubricating oil having been used in the engine to the supercharger and an oil discharge line for returning the lubricating oil having been used in the supercharger to the engine so that an engine lubricating oil is used in common in time supercharger. As a result, the present invention can offer excellent advantages that kinds of oils required for the operation of tile engine system can be decreased in number and that associated parts exclusively for the supercharger such as lubricating oil pump and oil cooler can be eliminated, which facts brings about decided advantages in adoption of an external oil feed type engine-driven supercharger from the standpoint of arrangements of various parts mounted on a vehicle and maintenance cost: provision of the lubricating oil feed port at a position adjacent to the rear of the rotor casing contributes to cooling of the lubricating oil by the air sucked through the suction port at the rear even when the lubricating oil fed through the oil feed port is high in temperature, resulting in effective lubrication of various parts to be lubricated such as bearings and sealing means, enhancement of durability thereof and reliability of the supercharger; provision of the lubricating oil passage downstream of the oil feed port in the wall of tile rotor casing away from the delivery port contributes to cooling of the lubricating oil at the cool portion of the rotor casing; and introduction of the distribution line branched from the lubricating oil feed line into the gear casing contributes to feed of the lubricating oil cooled by the rotor casing to those parts such as speed increasing gears which generate a large amount of heat.

INDUSTRIAL APPLICABILITY

As described above, a lubricating device for an engine-driven supercharger in accordance with the present invention is suitable for use in a smaller-sized vehicle which has difficulties in mounting a lubricating system exclusively for supercharging as well as in a higher-performance vehicle which requires higher degree of reliability of the supercharger.

We claim:

1. A lubricating device for an external engine-driven supercharger comprising oil feed line for feeding lubricating oil used in the engine to said supercharger and an oil discharge line for returning the lubricating oil used in said supercharger to said engine, whereby lubricating oil is used in common in said engine and supercharger, said engine-driven supercharger being of the type in which shafts of male and female rotors arranged in parallel with each other in a rotor casing are rotatably supported at a front and a rear of said rotor casing, an air suction port at the rear of said casing and a compressed air delivery port at the front of said casing, an oil feed port at the rear of said rotor casing, said delivery port being opened radially of the rotor casing and a lubricating oil passage downstream of the oil feed port and located in a wall the rotor casing diametrically opposite to said delivery port.

2. A lubricating device for an engine-driven supercharger as defined in claim 1 wherein a distribution line is branched from said lubricating oil passage to feed the lubricating oil to a gear casing at the front of the rotor casing.

3. A lubricating device for an engine driven supercharger including a casing having front and rear ends comprising an oil feed line for feeding lubricating oil used in the engine to said supercharger and an oil discharge line for returning the lubricating oil used in the supercharger to said engine, whereby lubricating oil is used in common in said engine and supercharger, an air suction port at the rear end of said casing, a compressed air delivery port at the front end of said casing, said delivery port opening radially of said casing, an oil feed port in a wall of said casing, and a lubricating oil passage in a wall of said casing downstream of said oil feed port and diametrically opposite said delivery port.

* * * * *